United States Patent [19]

Tapley et al.

[11] Patent Number: 4,898,113

[45] Date of Patent: Feb. 6, 1990

[54] OUT-RIGGER ASSEMBLY

[75] Inventors: Robin R. Tapley, Dwight; James W. Hatkoski, Huntsville; Richard J. Hatkoski, Dwight, all of Canada

[73] Assignee: Richard Hatkoski, d.b.a, Citadel Industries Ontario, Canada

[21] Appl. No.: 268,294

[22] Filed: Nov. 7, 1988

[51] Int. Cl.[4] ..... B63B 43/04

[52] U.S. Cl. ..... 114/283; 114/292

[58] Field of Search ..... 114/271, 283, 292, 61, 114/266, 267, 123; D12/300, 302, 303, 304

[56] References Cited

U.S. PATENT DOCUMENTS

| | | | |
|---|---|---|---|
| 603,469 | 5/1898 | Kautz | 114/283 |
| 1,303,508 | 5/1919 | Simpson | 114/283 |
| 3,115,860 | 12/1963 | Payne | 114/242 |
| 3,232,261 | 2/1966 | Craig | 114/283 |
| 3,450,084 | 6/1869 | Gerbracht | 114/283 |
| 3,777,690 | 12/1973 | Garber | 114/39 |
| 3,786,774 | 1/1974 | Gabel | 114/292 |
| 3,996,871 | 12/1976 | Boismard | 114/283 |
| 4,511,338 | 4/1985 | Fanelli | 441/74 |
| 4,541,356 | 9/1985 | Jones et al. | 114/61 |
| 4,545,772 | 10/1985 | Stockhausen | 441/74 |
| 4,688,504 | 8/1987 | Sulz | 114/39.1 |
| 4,752,261 | 6/1988 | Rosello Zoya | 441/74 |

*Primary Examiner*—Joseph F. Peters, Jr.
*Assistant Examiner*—Clifford T. Bartz

[57] ABSTRACT

An out-rigger assembly for releasable attachment to a conventional sail-board is provided to make it easier for users to keep their balance while learning to master the art of sail-boarding, also known as wind-surfing. The assembly comprises an essentially planar central deck or platform which is releasbly secured to the top surface of a sail-board usefully by straps which pass around the sail-board. Elongated members extend transversely outwardly from the central dark and at their ends are releasably connected to pontoons or out-riggers.

12 Claims, 3 Drawing Sheets

OUT-RIGGER ASSEMBLY

FIELD OF THE INVENTION

This invention relates to an out-rigger assembly for use with a conventional sail-board to make it easier for users to keep their balance particularly while they are learning how to operate such a sail-board.

BACKGROUND OF THE INVENTION

A conventional sail-board is shown in Canadian Patent No. 912,921. Persons frequently experience difficulty in learning the art of handling such sail-boards.

In U.S. Pat. No. 4,688,504, there is described an out-rigger assembly intended to be fitted on a conventional sail-board and stated to help users in learning how to operate such a sail-board. The assembly described in that particular patent specification, however, modifies the sail-board to such an extent that it must then be operated and controlled in a completely different manner from a conventional sail-board. For example, after having mounted the out-rigger assembly described in that earlier patent specification on a conventional sail-board, walking movement ono the sail-board is significantly restricted and, in fact, the operator must sit on the assembled structure rather than standing up as is normal with conventional sail-boards.

OBJECTS AND SUMMARY OF THE INVENTION

It is a principal object of this invention to provide an out-rigger assembly which can be releasably attached to most makes of conventional sail-boards to allow a learner more easily to master the art of sail-boarding, also known as wind-surfing.

It is a further object of this invention to provide an out-rigger assembly for the aforesaid purpose and which makes it easier for learners to maintain their balance particularly when they are attempting to elevate the sail of the board out of the water.

It is another object of this invention to provide an out-rigger assembly for the aforesaid purposes and which assembly is of an extremely simple and relatively inexpensive construction.

It is yet a further object of this invention to provide an out-rigger assembly which can be attached to and removed from the bodies of most makes of conventional sail-boards very quickly not only to facilitate transportation but also to permit a user to dispense with the assembly when so desired.

Yet another object of this invention is to provide an out-rigger assembly which does not require a user to operate the sail-board in a manner significantly different from that in which a sail-board is normally operated when no out-rigger assembly is mounted thereon.

These and other objects of the invention are achieved by means of an out-rigger assembly for use with a sail-board having a top surface and an undersurface and which out-rigger assembly can be broadly be defined as comprising an essentially planar central deck having an unencumbered top surface adapted to be disposed on said top surface of said sail-board without significantly restricting standing and walking movement of an operator on said sail-board; a releasable fastening means adapted removably to secure said central deck in position on said top surface of said sail-board; first and second support means extending transversely outwardly from said centre deck fromo opposite side edges thereof; and first and second pontoons releasably secured to respective ones of said first and second support means so as to be disposed in spaced apart and mutually parallel disposition relative to said sail-board on opposite transverse sides thereof when said central deck is secured in position on said sail-board.

In addition to providing an out-rigger assembly as hereinbefore defined, the present invention also embraces in combination: a sail-board having a top surface and an undersurface; and an out-rigger assembly in turn comprising an essentially planar central deck having an unencumbered top surface and disposed on said top surface of said sail-board without significantly restricting standing and walking movement of an operator on said sail-board; a releasable fastening means removably securing said central deck in position on said top surface of said sail-board; first and second support means extending transversely outwardly from said centre deck from opposite side edges thereof; and first and second pontoons releasably secured to respective ones of said first and second support means so as to be disposed in spaced apart and mutually parallel disposition relative to said sail-board on opposite transverse sides thereof.

To ensure positive non-slipping securement of the out-rigger assembly on such a sail-board, such an assembly usefully also comprises a resiliently compressible and essentially planar pad intended to be disposed between the central deck of the assembly and the top surface of the sail-board.

The releasable fastening means removably securing the central deck in position on the top surface of the sail-board usefully comprises at least one releasable fastening strap passing around the sail-board. Preferably, two such fastening straps are employed to ensure positive placement of the deck in position.

In one embodiment of the invention, the support means are integrally formed as a single elongated member extending transversely and removably through the central deck and outwardly therefrom.

Usefully, spacer members are then provided coaxially about said second elongated member on opposite sides of said central deck so as to maintain the pontoons in the desired spaced apart positions with respect to the sail-board itself.

Additionally, such elongated member usefully extends through transverse openings in the first and second pontoons, holding members, such as linch pins, then being provided releasably to engage the elongated member at opposite ends thereof to about the outer edges of the pontoons and to hold them in position against respective ones of the spacer members.

Other objects and features of the invention and the advantages presented thereby will become apparent as the description herein proceeds.

The various features of novelty which characterize the invention are pointed out with more particularity in the claims annexed to and forming a part of this disclosure. For a better understanding of the invention, its operating advantages and the specific objects attained by its use, reference should be had to the accompanying drawings and descriptive matter in which there is illustrated and described a preferred embodiment of the invention.

BRIEF DESCRIPTION OF THE DRAWINGS

The invention will now be described merely by way of illustration with reference to the accompanying drawings in which.

DESCRIPTION OF THE PREFERRED EMBODIMENT

Figure 1:
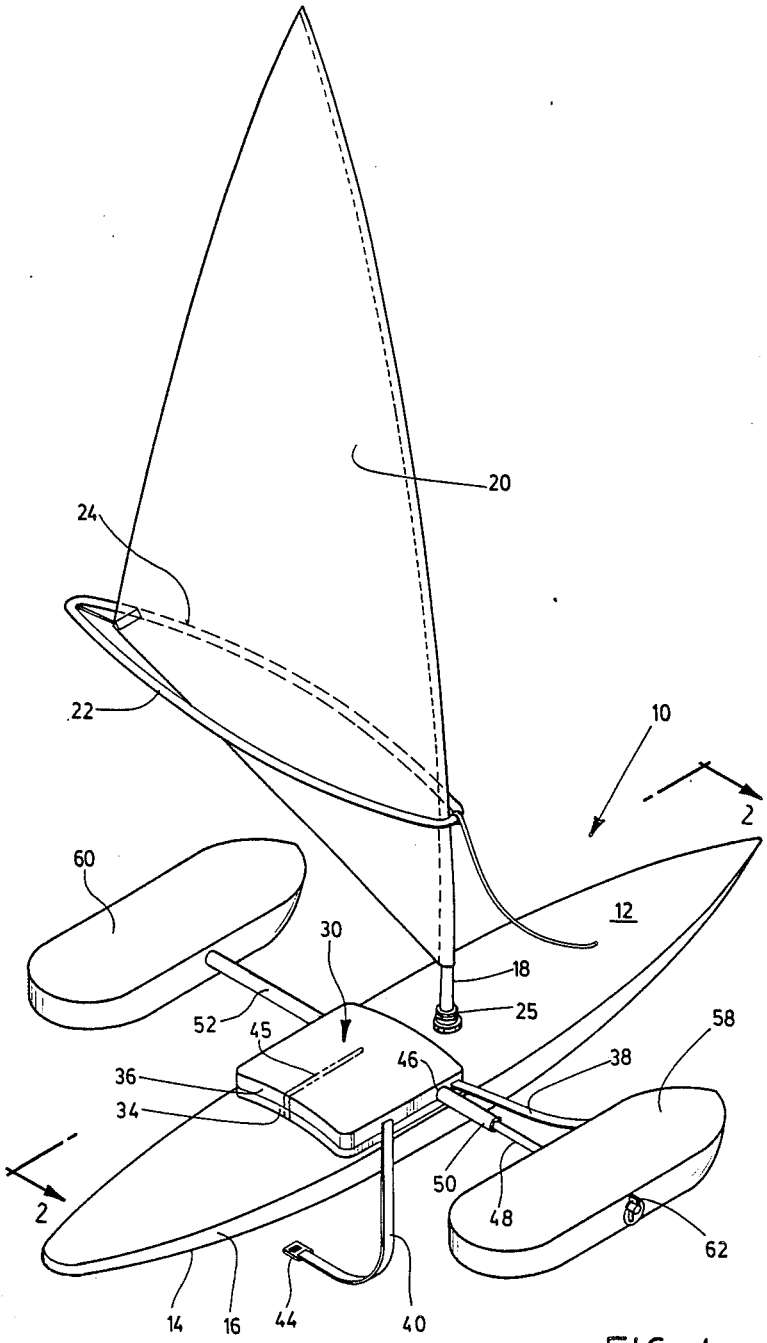
FIG. 1 is a perspective view of a conventional sail-board having an out-rigger assembly in accordance with this invention removably secured thereon.

The sail-board generally indicated at 10 in the accompanying drawings is of conventional construction and comprises a body of a suitable floatable material, such as a glass fibre-reinforced resin laminate or a hollow or foam-filled molded plastics material, and has a top surface 12, an undersurface 14 and side edge surfaces 16. Such a sail-board 10 is also provided in a conventional manner with a mast or spar 18 (shown fragmentarily in FIG. 2). It is also provided with a triangular sail 20 and booms 22 and 24 (omitted from FIGS. 2 and 3) which extend across the sail 20 on opposite sides thereof and which are spaced apart outwardly from the surfaces of the sail. The mast or spar 18 is pivotally mounted on the board 10 by a universal joint of conventional construction and enclosed in a flexible sleeve 25 and can, if desired, be mounted on a track permitting some longitudinal movement of the mast along the sail-board.

Figure 2:
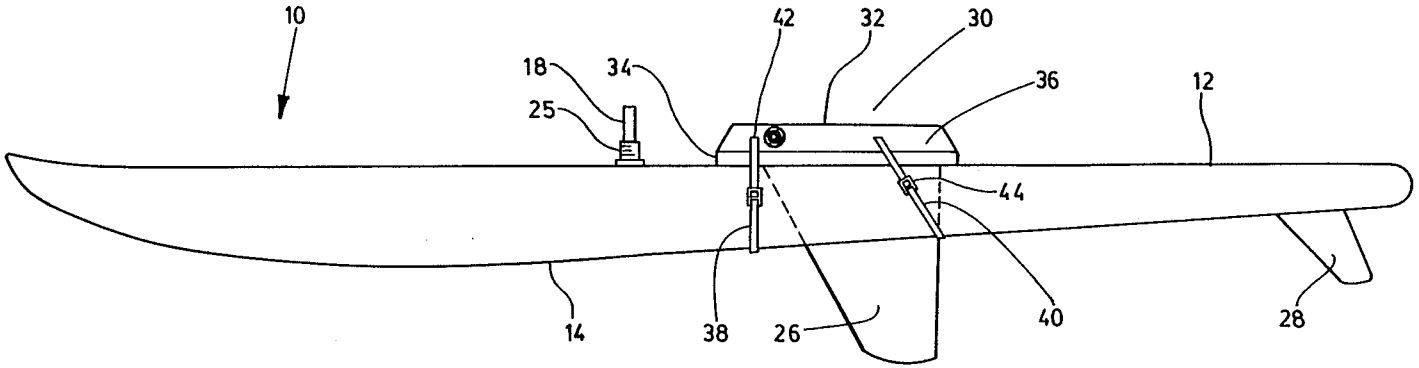
FIG. 2 is a side elevation when taken as indicated by the arrows 2—2 of FIG. 1.
Figure 3:
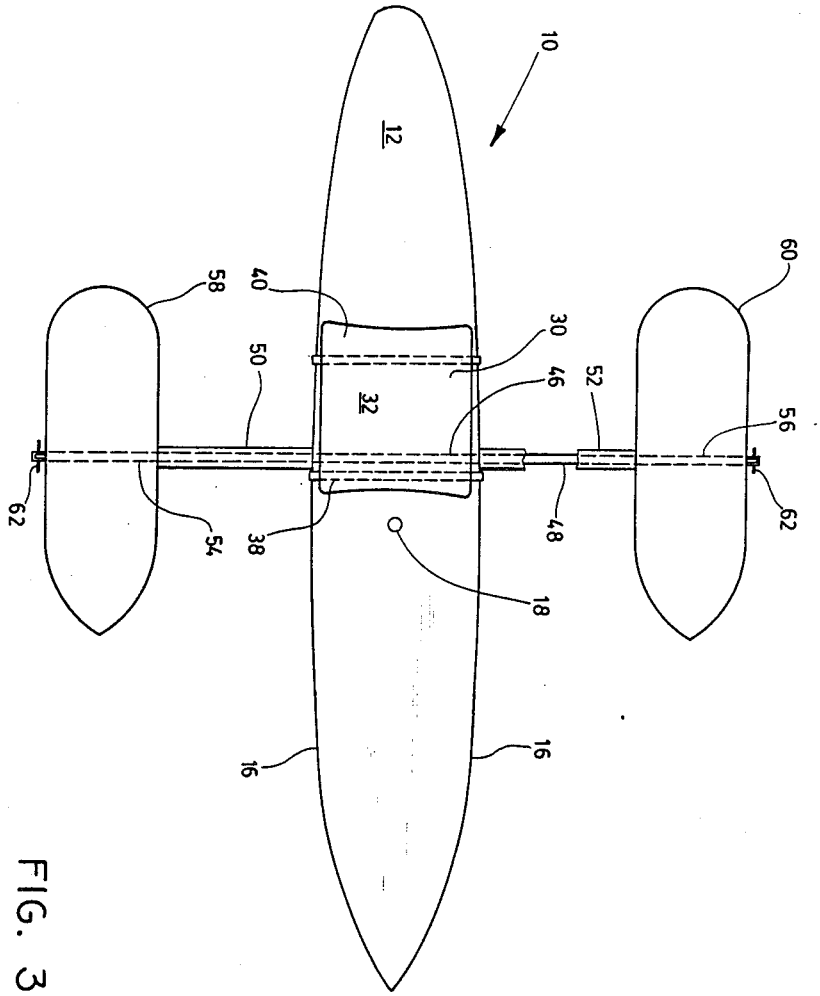
FIG. 3 is a plan view of the sail-board and out-rigger assembly shown in the preceding figures.

As shown only in FIG. 2, the sail-board 10 may also comprise a skeg 28 and a centre-board 26 which may be raised through an opening (not shown) in the sail-board 10. Since the sail-board 10 is typical of the construction and design of most makes of conventional sail-boards it is considered to be unnecessary to describe its construction or use in greater detail herein.

The out-rigger assembly in accordance with this invention comprises an essentially planar central platform or deck generally indicated at 30 and having an unencumbered top surface 32 and an undersurface 34. In general, the thickness of the deck 30 will be no more than about four inches and preferably will be no more than two inches. In accordance with a preferred feature of this invention, the out-rigger assembly usefully also comprises a resiliently compressible and essentially planar pad 36 which, in use, is disposed between the top surface 12 of the sail-board 10 and the undersurface 34 of the deck 30. The pad 36 is usefully formed of a non-water-absorbing closed cell elastomeric material such as neoprene and will normally have a thickness of no more than about 1.5 inches and preferably of no more than about 0.5 inch.

Two releasable straps 38 and 40, usefully formed of a water-resistant material such as nylon, extend through transverse passages 42 formed in the deck 30 and are each provided with a tension buckle 44. Such straps 38 and 40 are passed around the body of the sail-board 10 to permit the deck 30 to be secured firmly in position. To further ensure a positive securement of the deck 30 in position, the undersurface 34 of that deck usefully has a slightly concave configuration complementary to the convex configuration of the top surface 12 of the sail-board 10. It will be understood that, during such attachment of the deck 30, the pad 36 will be somewhat compressed thereby and conform to the shaping of top surface 12 to prevent slippage of the deck on the sail-board.

Referring now to FIG. 2 of the accompanying drawings, it will be seen that the straps 38 and 40 extend around the body of sail-board 10 opposite longitudinal sides of the centre-board 26.

If desired, the deck 30 may be formed with a central recess indicated in phantom at 45 in FIG. 1 to permit the centre board 26 to be raised when desired.

A further transverse passage 46 extends through the deck 30 to receive an elongated tubular member 48 which in use extends transversely beyond both sides of the sail-board 10. To keep the nose of the sail-board 10 out of the water, the elongated member 48 should preferably be disposed slightly aft of the centre of gravity of the board 10. Coaxially disposed about the tubular member 48 on opposite transverse sides of the sail-board 10, there are provided tubular spacer members 50 and 52. Outwardly of the spacer members 50 and 52, the tubular member 48 passes through transverse passages 54 and 56 respectively in first and second pontoons 58 and 60 respectively. The pontoons 58 and 60 are formed of any suitable floatable material, such as a glass fibre-reinforced resin laminate or a hollow or foam-filled molded plastics material, and are held in position on the tubular member 48 by linch pins 62 of a conventional type as will readily be understood by reference to FIG. 1.

For use, the out-rigger assembly can be transported to the place of use already secured to the sail-board 10 in the manner already explained. Alternatively, the out-rigger assembly can be transported dismantled and separately from the sail-board 10 and then secured thereto at the location where it is to be used.

In use, the out-rigger assembly makes it easier for a learner to master the art of sail boarding. Particularly, it allows a learner to elevate the sail out of the water without having a worry about balancing the sail-board. Since both the central deck 30 and the resiliently compressible pad 36 are relatively thin and since the top surface 32 of the deck 30 is unencumbered, their presence on the sail-board 10 does not significantly affect the operator when he is standing on or moving about on the sail-board.

A further advantage of the out-rigger assembly of this invention is the ease with which it may be fitted to and removed from most makes of conventional sail-boards either for transportation purposes or to allow a user to forego the use of the assembly once such a user has become more expert in the operation of a sail-board. In practice, it has been found that such operations take only a few minutes.

Having described what is believed to be the best mode by which the invention may be performed, it will be seen that the invention may be particularly defined as follows:

An out-rigger assembly for use with a sail-board having a top surface and an undersurface and which assembly comprises an essentially planar central deck having an unencumbered top surface and adapted to be disposed on said top surface of said sail-board without significantly restricting standing and walking movement of an operator on said sail-board; at least one releasable fastening means adapted removably to secure said central deck in position on said top surface of said sail-board; first and second support means extending transversely outwardly from said centre deck from opposite side edges thereof; and first and second pontoons releasably secured to respective ones of said first and second support means so as to be disposed in spaced apart and mutually parallel disposition relative to said sail-board on opposite transverse sides thereof when said central deck is secured in position on said sail-board.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An out-rigger assembly for use with a sail-board having a top surface and an undersurface and which assembly comprises:

an essentially planar central deck having an unencumbered top surface and adapted to be disposed on said top surface of said sail-board without significantly restricting standing and walking movement of an operator on said sail-board;

at least one releasable fastening strap adapted pass around said sail-board and removably to secure said central deck in position on said top surface of said sail-board;

first and second support means extending transversely outwardly from said centre deck from opposite side edges thereof; and first and second pontoons releasably secured to respective ones of said first and second support means so as to be disposed in spaced apart and mutually parallel disposition relative to said sail-board on opposite transverse sides thereof when said central deck is secured in position on said sail-board.

2. An out-rigger assembly as claimed in claim 1 and which additionally comprises a resiliently compressible and essentially planar pad adapted to be disposed between said central deck and said top surface of said sail-board.

3. An out-rigger assembly as claimed in claim 2 and in which said first and second support means are integrally formed as a single elongated member extending transversely and removably through said central deck and outwardly therefrom.

4. An out-rigger assembly as claimed in claim 3 and which additionally comprises spacer members coaxially disposed about said elongated member on opposite sides of said central deck.

5. An out-rigger assembly as claimed in claim 4, in which said elongated member passes through transverse openings in said first and second pontoons, and which additionally comprises holding members releasably engaging said elongated member at opposite ends thereof and abutting outer edges of said pontoons to hold them in position against respective ones of said spacer members.

6. An out-rigger assembly as claimed in claim 5 and which comprises two said releasable fastening straps engaging said sail-board at longitudinally spaced apart positions therealong.

7. In combination:

a sail-board having a top surface and an undersurface; and an out-rigger assembly in turn comprising:

an essentially planar central deck having an unencumbered top surface and disposed on said top surface of said sail-board without significantly restricting standing and walking movement of an operator on said sail-board;

at least one releasable fastening strap passing around said sail-board and, removably securing said central deck in position on said top surface of said sail-board;

first and second support means extending transversely outwardly from said centre deck from opposite side edges thereof; and first and second pontoons secured to respective ones of said first and second support means so as to be disposed in spaced apart and mutually parallel disposition relative to said sail-board on opposite transverse sides thereof.

8. A combination as claimed in claim 7 and which additionally comprises a resiliently compressible and essentially planar pad disposed between said central deck and said top surface of said sail-board.

9. A combination as claimed in claim 8 and in which said first and second support means are integrally formed as a single elongated member extending transversely and removably through said central deck and outwardly therefrom.

10. A combination as claimed in claim 9 and which additionally comprises spacer members coaxially disposed about said elongated member on opposite sides of said central deck.

11. A combination as claimed in claim 10, in which said elongated member passes through transverse openings in said first and second pontoons, and which additionally comprises holding members releasably engaging said elongated member at opposite ends thereof and abutting outer edges of said pontoons to hold them in position against respective ones of said spacer members.

12. A combination as claimed in claim 11 and which comprises two said releasable fastening straps engaging said sail-board at longitudinally spaced apart positions therealong.

* * * * *